United States Patent [19]

Bausch et al.

[11] Patent Number: 4,605,047

[45] Date of Patent: Aug. 12, 1986

[54] FILLING DEVICE FOR BULK MATERIAL, ESPECIALLY LIQUIDS

[75] Inventors: Wilhelm L. Bausch; Rolf Ströbel; Siegfried Bullinger; Harald Harlass, all of Ilshofen; Walter Busch, Grundelhardt, all of Fed. Rep. of Germany

[73] Assignee: Bausch & Strobel Maschinenfabrik GmbH & Co., Fed. Rep. of Germany

[21] Appl. No.: 557,146

[22] PCT Filed: Mar. 17, 1983

[86] PCT No.: PCT/DE83/00049

§ 371 Date: Nov. 15, 1983

§ 102(e) Date: Nov. 15, 1983

[87] PCT Pub. No.: WO83/03235

PCT Pub. Date: Sep. 29, 1983

[30] Foreign Application Priority Data

Mar. 17, 1982 [DE] Fed. Rep. of Germany ..... 3209790

[51] Int. Cl.[4] ..... B65B 1/32; B65B 57/10

[52] U.S. Cl. ..... 141/83; 141/165; 141/168; 141/85; 198/625; 198/662; 177/52

[58] Field of Search ..... 141/83, 129, 163, 165, 141/168, 171, 176–179, 181, 135, 85, 82, 93, 1, 234; 251/4, 7, 9, 138; 198/625, 626, 662, 657; 177/1, 25, 52

[56] References Cited

U.S. PATENT DOCUMENTS

| | | | |
|---|---|---|---|
| 1,604,133 | 10/1926 | Rebechini | 198/625 X |
| 1,750,329 | 3/1930 | Patchen et al. | 198/676 X |
| 2,730,226 | 1/1956 | Day et al. | 198/676 X |
| 2,842,331 | 7/1958 | Anderson | 251/6 |
| 2,890,787 | 6/1959 | Carter | 198/625 X |
| 3,168,183 | 2/1965 | Copper | 198/625 X |
| 3,544,060 | 12/1970 | Stoltz et al. | 251/9 |
| 3,648,741 | 3/1972 | Croasdale | 141/9 |
| 3,717,184 | 2/1973 | Bischof | 141/1 |
| 3,990,212 | 11/1976 | Flodin | 141/83 X |
| 4,004,620 | 1/1977 | Rosen | 141/137 |
| 4,084,626 | 4/1978 | King | 141/7 |
| 4,133,314 | 1/1979 | Bloom et al. | 141/27 X |
| 4,230,151 | 10/1980 | Jonsson | 251/7 X |
| 4,266,691 | 5/1981 | Wolwowice | 141/83 X |
| 4,275,775 | 6/1981 | Egli | 141/83 |
| 4,469,146 | 9/1984 | Campbell et al. | 141/9 |
| 4,491,167 | 1/1985 | Lange et al. | 198/625 X |
| 4,495,974 | 1/1985 | Pohorski | 141/163 X |

FOREIGN PATENT DOCUMENTS

| | | | |
|---|---|---|---|
| 0082990 | 7/1983 | European Pat. Off. | 141/129 |
| 2951665 | 12/1979 | Fed. Rep. of Germany . | |
| 2919488 | 11/1980 | Fed. Rep. of Germany | 198/625 |
| 82/03832 | 11/1982 | World Int. Prop. O. | 141/129 |
| 1187551 | 4/1970 | United Kingdom | 141/129 |
| 2097770 | 11/1982 | United Kingdom | 141/85 |

*Primary Examiner*—Stephen Marcus
*Assistant Examiner*—Ernest G. Cusick
*Attorney, Agent, or Firm*—Wood, Dalton, Phillips, Mason & Rowe

[57] ABSTRACT

For the metered filling of bulk material, especially liquids, into receptacles, especially glass receptacles, there is provided a filling station to which a conveying device leads the receptacles, which are to be filled, individually or in groups. A weighing device determines before the start of the filling operation the tare of the receptacles which are to be filled, and blocks the feeding of bulk material when a specified gross weight has been reached. The conveying device moves the receptacles preferably by means of worm conveyers which are lifted off the receptacles during the weighing and filling operation.

18 Claims, 15 Drawing Figures

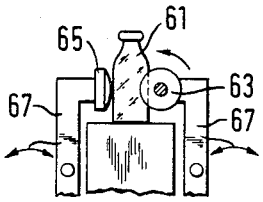
FIG. 6
FIG. 7
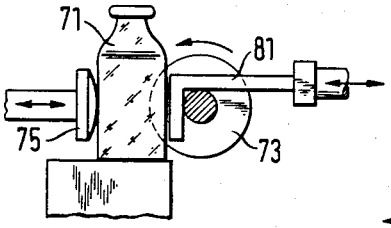
FIG. 8
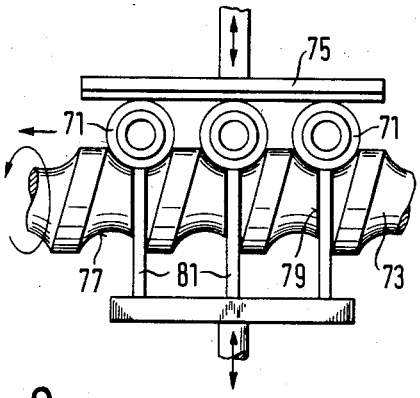
FIG. 9
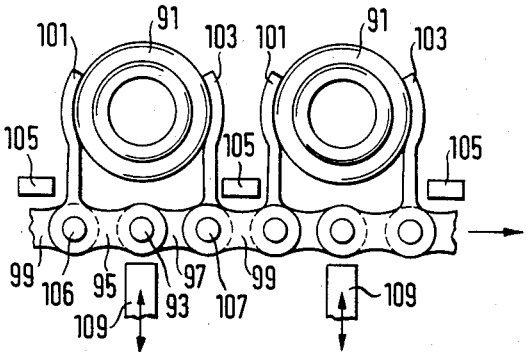

FIG. 10
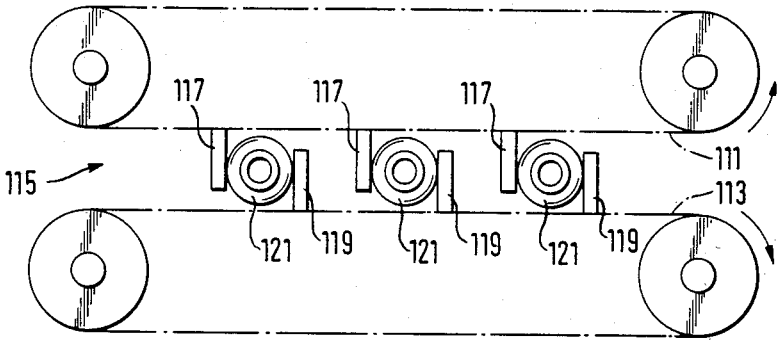
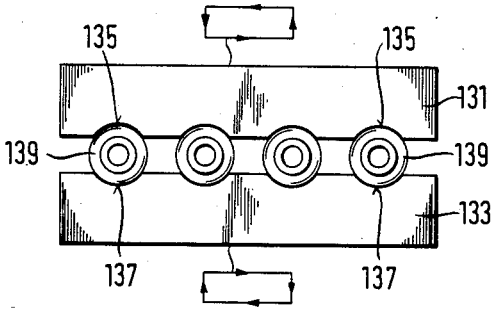
FIG. 11
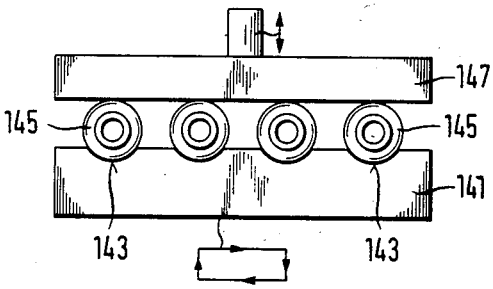
FIG. 12

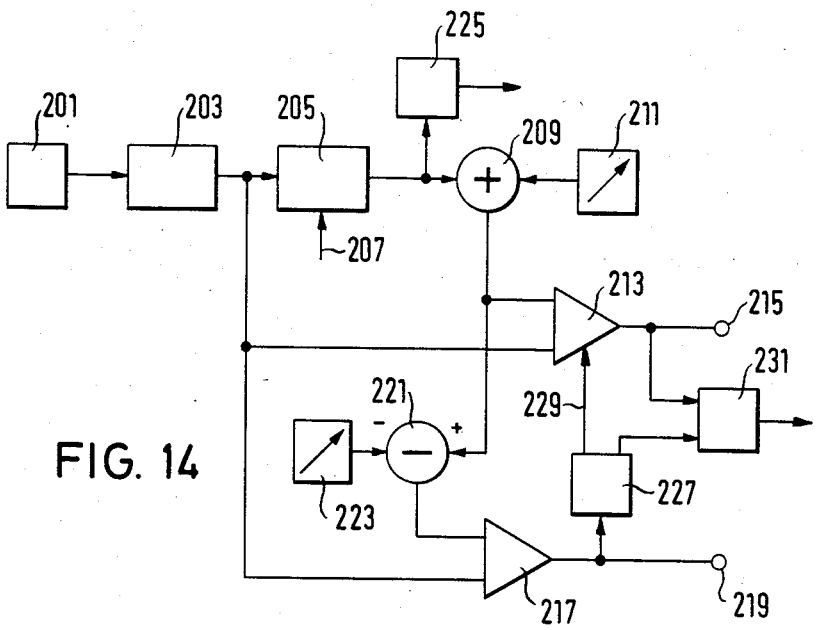
FIG. 14
FIG. 15
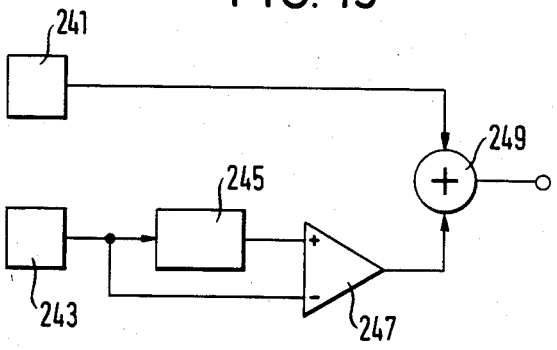

FILLING DEVICE FOR BULK MATERIAL, ESPECIALLY LIQUIDS

FIELD OF THE INVENTION

The invention relates to a device for the metered filling of bulk materials, especially liquids, into receptacles; it has a filling station including the metering device for the bulk material, a conveying device moving the receptacles through the filling station, and a weighing device for the bulk materials which controls the metering device.

BACKGROUND ART

A filling device of this type has become known from the German patent application No. 29 51 665. On this system the conveying device moves each of the receptacles successively past several dosing units each of which meters a part of the bulk material to be filled in and after an intermediate filling into the weighing dish of a weighing unit, controlling the dosing unit, it transfers the material to the receptacle. Each of the dosing units is controlled by a timing circuit which determines the opening time for the flow of bulk material. The weighing unit itself controls the timing circuit of the pertaining dosing unit dependent on the specified tolerance limits. A signal memory adds for each of the receptacles the quantities of bulk material filled by the dosing units into the receptacle.

The expense of construction of the well-known system is relatively high. Several complete weighing and dosing units are necessary in order to be able to observe sufficiently narrow tolerances of the quantity of bulk material filled in. The tolerances are determined by the tolerance limits of the dosing unit, which is last in the charging course, and are so high that they are insufficient for many cases of application, especially for the filling of liquids. By means of the well-known system, merely solid bulk materials are therefore filled.

Furthermore there has been known the volumetric dosing and filling of liquids by means of piston pumps and the like. It is true, the well-known liquid filling systems are able to observe filling tolerances very accurately but they are relatively expensive with respect to construction. Beyond that, the dosing pumps are difficult to clean which causes problems especially in connection with the filling of sterile liquids. Moreover, the abrasion dust of the mechanically moved parts of the dosing pump increases the number of foreign particles in the liquid to be filled.

SUMMARY OF THE INVENTION

It is an objective of the present invention to provide a structurally simple device by means of which bulk material and especially liquids can be filled into receptacles at narrow tolerances.

As defined in the invention, this problem is solved by the fact that during the charging of each receptacle in the filling station with bulk material the weighing device monitors the weight of that receptacle and blocks the flow of bulk material of the dosing device when the weight of that receptacle exceeds a predetermined value. In contrast to the well-known filling device, the weighing device monitors the quantity of bulk material actually filled into the receptacle. Dosing errors, as they can occur in connection with the well-known filling device during the refilling of the quantity of bulk material, which was put by the dosing unit into the weighing dish, into the receptacle are avoided. The receptacle is filled in one filling operation, and therefore it does not have to pass through several differently dimensioned dosing units. The cost of construction is low, yet the device affords great accuracy in measuring.

Special advantages result in connection with the filling of liquids. The device has few moving parts—and no moving parts if hose squeezing valves are used, which are in contact with the liquid to be filled so that no abrasion dust or other particles can be carried into the liquid. In contrast to conventional liquid filling devices, the parts coming into contact with the liquids can be cleaned easily. Without changing parts, for instance, pump cylinders and the like, a large filling range can be covered. Since dosing pumps are not used, product losses are comparatively small, a fact which is especially advantageous in connection with expensive products. Since no dosing pumps and the like are used, the spatial measurements of the filling station are also small. This is advantageous for the setting up of the filling station in clean air rooms or clean air flows.

In a preferred embodiment, the filling station includes several filling places having one weighing unit and one dosing unit for each of the filling places. The conveying device conveys the receptacles groupwise to the filling places where they can be simultaneously charged with bulk material.

The device is simplified if the weighing units have weight sensors arranged successively in the conveying direction of the receptacles and the conveying device, in the conveying direction, has at least on one side of the weight sensors a conveying element which is elongated in the conveying direction and has several slide surfaces following each other at the distance of the weight sensors and reaching behind the receptacles. The conveying organ is intermittently moved in a first direction in which the slide surfaces move the receptacle in the specified conveying direction. During the interruptions in the conveying, the conveying organ is moved in a second direction, in which the slide surfaces lift away from the receptacles present above the weight sensors. During the weighing operation, the receptacles stand free on the weight sensors of the weighing device.

The conveying organ is preferably designed as a rotationally driven worm conveyer in whose worm thread the containers engage. The receptacles can be held in a worm thread by means of a guide rail parallel to the conveyer worm. However, also two conveyer worms parallel to each other and rotationally driven and having an opposing worm thread pitch can be provided which hold the receptacles between them. By means of such worms several receptacles can be moved simultaneously through the filling station and its filling places without great structural expense. The shape of the cross section of the receptacles does not need to exactly match the shape of the worm thread. Receptacles having greatly different sizes can be conveyed by means of a specified conveyer worm. If required, change-over couplings for the operational changing of conveyer worms can be provided.

In order to be able to set the receptacles free during the weighing and filling operation, the conveyer worm or worms and possibly the guide rail are mounted for movement transverse to the conveying direction. The conveying device lifts the conveyer worms or the guide rail away from the receptacles during the interruptions in the conveying so that the receptacles stand free on the weight sensors. For conveyer worms which surround the receptacles with axial and radial play, and as an alternative to the above the conveying device can be operated to twin back the worms by a predetermined angle of rotation in order to free the receptacles whereby the slide surfaces of the worm spiral lift from the receptacles.

The mechanical drive of the worm conveyer can have a relatively great rotative movement. In the individual case this can lead to problems in connection with the exact positioning of the receptacles on the weight sensors of the filling places and the positioning of the receptacles relative to the filling devices, for instance, filling needles. An exact positioning of the receptacles is achieved if the conveyer worm is provided in the conveying direction, laterally of the weight sensors, with worm threads which run normal to the worm axis over a part of the circumference of the worm. In the zone of these normal worm threads, the receptacles are not moved in spite of the rotating conveyer worms. The conveyer worm is stopped in the zone of these rest threads.

In another embodiment, the conveyer worm can be provided with flattenings or recesses which reduce the radius of the worm thread over a part of the circumference of the worm. The flattenings or recesses, provided preferably in the zone of the previously explained rest threads of the worm thread, release the receptacles which stand on the weight sensors during the weighing and filling operation. Worm conveyers, especially worm conveyers of this type arranged pairwise parallel to each other, can be operated continuously. The worm conveyers need neither to be stopped nor to be moved away from the receptacles transverse to the conveying direction of the receptacles during the interruptions of the conveying.

The receptacles are generally delivered by conveyer belts or buffer devices standing closely adjacent to each other. In the zone of the filling places the receptacles must be kept spaced from each other or they are conveyed so that during the weighing and filling operation they have no contact with each other. This can be achieved in a simple manner by an increase of the pitch of the worm thread of the worm conveyer from the zone of the receptacle receiving end of the worm conveyer toward the zone of the weight sensors. The pitch of the thread decreases from the zone of the weight sensors to the receptacle discharge end of the worm conveyer so that the receptacles can be transferred nearly shockless to a removing conveyer belt, a discharge buffer or the like.

In place of a worm conveyer, an endless chain can be used as the conveying organ. At least part of the chain links, connected with each other and swingable around vertical axes, can have arms which protrude rigidly transverse to the longitudinal direction of the chain and pairwise enclose the receptacles between them. The arms form pincers which grip the receptacles and convey them to a predetermined position. At the filling places of the filling station, the arms must be raised from the receptacles. In a simple embodiment this is made possible by chain link guides, which guide the chain links transverse to the longitudinal direction of the chain. The guide are designed in such a way that in the zone of the weight sensors they permit a swinging motion of the pairs of chain links, which are provided with arms, relative to the chain link that precedes or follows the pair each time in the longitudinal direction of the chain. Activating elements of the conveying device, for instance, in the form of cams or push ratchets, swing the chain links, which are provided with arms, in the opposite direction during the interruptions of the conveying and thereby open the arm pincers.

In another embodiment, the conveying device can be provided with two endless chains which run parallel to each other in the zone of the conveying path of the receptacle. Each of the two endless chains is provided with uniformly spaced arms which in the zone of the conveying path protrude toward the other chain. In the interruptions in the conveying of the receptacles of the weighing and filling operation, the continuous chain, whose arms follow the container in the conveying direction and thus push it, is moved by a specified length in a direction opposite to the conveying direction while the other chain continues running in the conveying direction. During the interruptions of the conveying, the receptacles thus stand free on the weight sensors of the weighing device. In place of chains with discrete chain links, also flexible pulling elements, for instance band-shaped elements equipped with arms, can be provided.

In another embodiment, the conveying organ of the conveying device can be designed as a rack having several receptacle holders following each other in the conveying direction. The conveying device moves the rack along a closed path, with the rack releasing the receptacles during its backstroke. The backstroke can simultaneously be utilized for the weighing and filling operation. In this embodiment, there can also be provided either two racks parallel to each other, whose receptacle holds are located opposite each other, or a guide rail can be provided which holds the receptacles in the receptacle holds of the rack. Where a guide rail is provided, the conveying device also lifts the guide rail from the receptacles during the interruptions in the conveying, at least in the zone of the filling places.

The filling device is suited especially for the accurately metered filling of liquids since the dosing pumps, commonly used, are eliminated. The liquids to be filled do not get in contact with any structural parts endangered by abrasion dust with the liquid flow controlled by means of hose squeezing valves. Hose squeezing valves are advantageously used especially if sterile liquids, for instance, medicines and the like, are supposed to be filled. The mechanically moved parts of the hose squeezing valve do not come in contact with the liquid so that merely the hose and possibly filling mouthpieces or filling needles must be cleaned and sterilized. Conveying pumps are not necessary if the liquid tank is arranged above the filling needles or is designed as a pressure tank under gas pressure.

The hose squeezing valve is preferably made in such a way that its hose squeezing pincers are pretensioned in the blocking direction by a closing spring. In case of interruptions in the operation and of current breakdown, the hose squeezing valve remains closed and the liquid to be filled cannot run out.

In order to be able to dose accurately and nevertheless to reach a high filling performance, the bulk material or the liquid in the beginning is filled with a high weight rate of flow which is then reduced toward the end of the filling operation. The weight rate of flow is preferably changed in steps. A separate hose squeezing valve can be assigned to each step and possibly also separate filling mouthpieces or filling needles can be used. By an adjustment of the cross section of the outlet of the filling mouthpiece or the filling needle to the weight rate of flow, the dripping of the liquid after the blocking of the hose squeezing valve can be prevented. However, in order to keep the valve expense as low as possible, the hose squeezing valve is preferably made in such a way that the hose squeezing pincers are opened in several throughput steps of the flow. For that purpose, several drives with drive strokes different from each other are preferably provided. Electromagnets with movable armatures opening the hose squeezing pincers are especially suited as drives. The stroke of each armature or an idle movement in the power transfer path between armature and hose squeezing valve is preferably adjustable.

For the filling of sterile liquids, a sterilizing filter is frequently inserted into the hose line, which leads to the filling mouthpiece or to the filling needle of the filling station, and is intended to reduce the number of foreign particles in the liquid. On conventional liquid metering devices the sterilizing filter is inserted between the dosing pump and the filling mouthpiece or the filling needle. Because of the considerable flow resistance of the sterilizing filter, the connection hose to the sterilizing filter expands during the filling operation. Because of the pressure which builds up here in the feed lines of the sterilizing filter, well-known filling devices have a tendency to drip. The dripping is avoided if the sterilizing filter is inserted before the hose squeezing valve, which is possible without the danger of contamination.

For the filling of sterile bulk materials or liquids, the filling station is frequently exposed to a laminar sterile-filtered air stream of a clean air blower. On conventional liquid filling machines the clean air blower is arranged above the filling station and charges the filling station with an air stream directed vertically downward. Since for the filling machines as defined in the invention no dosing pumps or the like are required, a relatively low profile structure results. In a preferred form, the clean air blower can now be arranged laterally of the filling station from where it charges the filling station substantially horizontally from the side opposite the operating side. The cross section of the flow of the clean air blower does not have to be increased in spite of the improved degree of purity compared to conventional filling machines. As a rule, even a reduction is possible. The clean air blower is arranged on the side of the receptacles opposite a filling needle carrier which is moved up and down.

The filling station and the conveying device are expediently held on a common bench, for instance, in order to be able to combine possible stroke movements of filling mouthpieces or filling needles with the conveying movement of the conveying device. The transmission of drive vibrations to the weighing device can be avoided in a simple manner by holding all weight sensors of the weighing device on a frame set up separately from and independent of the bench of the filling station or of the conveying device.

The weighing device shuts off the flow of bulk material when a predetermined value of the gross weight has been reached. As far as receptacles having a uniform weight when empty are used, a desired value increased by the tare or empty weight can be specified in place of the desired net weight. If, however, the empty weight of the receptacles fluctuates as it is the case especially with glass receptacles, for instance, bottles or ampoules, the fluctuating empty weight must be determined separately and taken into consideration. In a preferred embodiment there is connected to an electric weight sensor, which is loadable with the weight of the receptacle and transmits a signal corresponding to the weight, a signal scanning and holding step synchronized with the motion cycle of the conveying device. The signal scanning and holding step is triggered in such a way that it scans the signal, which corresponds to the weight of the receptacle, at a time when the receptacle is already at rest on the weight sensor but the filling operation has not yet started. An addition step adds the tare signal value stored in the signal scanning and holding step to a net weight signal value of an adjustable desired value transmitter. During the filling operation, the addition step furnishes therewith continuously a signal corresponding to the desired gross weight of the filled receptacle. During the filling operation, a comparator step compares the signal furnished by the addition step with the signal of the weight sensor and blocks the flow of bulk material of the dosing device when the measured actual weight of the receptacle has reached the desired gross weight.

As mentioned before, the bulk material throughput of the dosing device is preferably changeable in steps in order to be able to fill the receptacle fast in the beginning and to dose accurately when the charging is nearly completed. The previously mentioned comparator step controls preferably the smallest throughput of the dosing device. For each of the other throughput steps another adjustable desired value giver is provided which determines the weight at which switching from one throughput step to the next lower one is supposed to take place. On this other reference input, weight differences to the desired gross weight of the receptacle can be set when a subtraction step subtracts its signal from the gross signal. As an alternative, however, gross weights can also be set on this other desired value setter if additional steps are provided which add the signals of these reference inputs to the tare signal value of the signal sensing and holding device. Moreover, further comparator steps are provided for the control of the other throughput steps of the metering device.

In an expedient design of the weighing device, a monitoring circuit monitors the signal state cf the comparator step provided for the control of the smallest throughput step of the metering device. To the comparator step pertaining to the next larger throughput step a timing circuit is connected which activates the monitoring circuit after the end of its predetermined time constant. If after the end of the predetermined period the comparator step assigned to the smallest flow throughput step gives already a signal blocking the throughput, this means that the receptacle is already overfull, and, therefore that the swelling value of the next larger throughput step must be changed. If, on the other hand, the smallest flow throughput step is still open after the end of the predetermined time of the timing circuit, this indicates too large a flow throughput of the higher flow throughput steps and an eventually possible increase of the filling performance.

Vibrations of the weight sensors can lead to false measurings. Therefore embodiments which permit a compensation for undesirable vibrations of the weight sensors are of essential importance. In a preferred embodiment there is provided within the zone of the filling station a compensation weight sensor which is loaded with a constant weight and to which a mean value memory is connected which forms the mean time value of the signal of the compensation weight sensor. A subtraction step forms the difference of the signals of the compensation weight sensor and of the mean value memory and subtracts this difference signal from the signal of the measuring weight sensor loaded with the receptacle. The mean value memory furnishes a signal which essentially corresponds to the rest weight of the weight loading the compensation weight sensor. The difference of the signals of the compensation weight sensor and of the mean value memory is proportionate to the weight change caused by vibrations and is used for the compensation of the weight changes caused on the measuring weight sensor by the vibrations. The weight loading the compensation weight sensor is preferably equal to the desired gross weight of the receptacle.

Embodiments of the invention will now be explained in detail in the following.

BRIEF DESCRIPTION OF THE DRAWINGS

FIGS. 6 to 12 show schematic illustrations of other conveying devices usable for the conveying of receptacles through a filling station according to FIG. 1;

FIG. 14 shows a block diagram of a weighing device usable in the filling station according to FIG. 1 in order to control the dosing;

FIG. 15 shows a circuit usable in the circuit according to FIG. 14 for the compensation of undesired vibrations of the weight sensors.

DETAILED DESCRIPTION OF THE DRAWINGS

Figure 1:
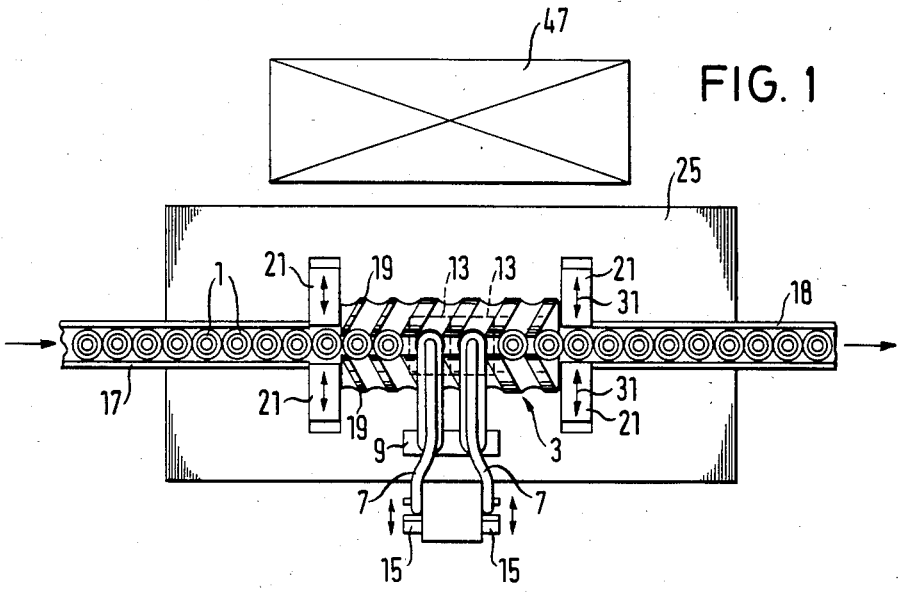
FIG. 1 shows a schematic top view of a filling station for the metered filling of liquid into receptacles, especially glass receptacles.
Figure 2:
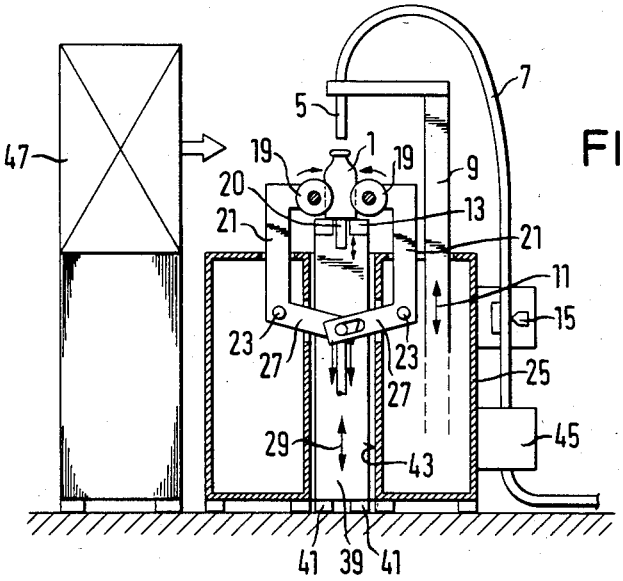
FIG. 2 shows a side elevation view of the filling station partially in cross section according to FIG. 1.

FIGS. 1 and 2 show a filling station by means of which liquid, which is metered according to weight, can be filled into two receptacles 1, especially glass receptacles, for instance, bottles or ampoules. By a conveying device 3, the receptacles 1 are brought in groups of two receptacles each under filling needles 5 where in a rest position they are charged with liquid. The filling needles 5 are connected by way of a hose 7 with a supply tank which is not shown in detail, for instance, a pressure tank which is under gas pressure. The filling needles 5 are inserted into the receptacles situated beneath the needles. A carrier 9 and thereby the filling needles 5 are raised after the filling. The filling station can be equipped with a single filling needle 5 but it can include also more than two filling needles.

The dosing of the quantity of liquid to be filled into the receptacles is determined by the weight of the liquid. Under the filling needles 5 there are arranged spaced weight sensors 13 which sense the weight of the receptacles 1, which are conveyed under the filling needles 5 by the conveying device 3, and evaluate it. As it will be explained in the following, each of the weight sensors 13 determines first the empty weight or tare of the receptacle 1 resting on it. A weighing device determines for each of the receptacles to be filled a nominal gross weight value from a specified net weight value and the measured tare value. During the filling operation, the weight sensors 13 measure continuously the actual weight of the receptacles. By way of hose squeezing valves 15 on the hose 7 of the filling needles 5, the weighing device blocks the feed of liquid into the receptacle when the actual weight of the receptacle has reached the predetermined desired gross weight.

The filling station has no dosing pumps or stop valves with parts which are endangered by abrasion dust and are in contact with the liquid. Since merely the filling needles 5 and the hose 7 get in contact with the liquid, the filling station can be cleaned easily.

The conveying device 3 conveys the receptacles 1 in a linear row successively through the filling station. A conveyer belt 17 guides the empty receptacle to the conveying device 3; a conveyor belt 18 moves the filled receptacles away. The conveying device 3 includes two worm conveyers 19, which are arranged axially parallel relative to each other and whose ends are placed on supporting arms 21. The worm conveyers 19 each have opposingly rising threads which form holding spaces for the receptacles 1 between the worm conveyers. A driving system, which is not shown in detail, drives the worm conveyers 19 with the same number of revolutions but in opposite directions so that the receptacles 1 below the filling needles 5 are conveyed to the conveyer belt 18 by the conveyer belt 17.

During the filling operation the receptacles must be at rest on the weight sensors 13 and without contact with the worm conveyers 19 in order to exclude measuring errors. As can be seen best in FIG. 2, the supporting arms 21 of the worm conveyers 19 are placed on a frame 25 of the filling station at 23 and are movable around an axis parallel to the axis of the worm conveyer. A drive acting vertically on the supporting arms 21 as indicated by double arrow 29, by way of slotted push levers 27, moves the worm conveyers 19 in the direction of a double, arrow 31, transverse to the worm axis selectively towards and away from each other the weighing and filling phase away from each other. The worm coneyers 19 are lifted from the receptacles 1 before the tare determination and are made to engage again with the receptacles after the completion of the charging with liquid.

The synchronization of the rotation of the worm conveyers, the movement of the supporting arms 21 and the movement of the carrier 9 can take place, on the one hand, by way of conventional cam disk drives, or, alternatively, by way of electrical contactors which control electrically controllable drive couplings. Such a coupling is preferred for the control of the worm rotation in order to stop the worm in the filling position of the receptacle. The movement of the carrier 9 and of the supporting arms 21 can be controlled jointly by way of another coupling. The stopping of the worm conveyer 19 is controlled by a position transmitter which detects a predetermined worm position that takes into consideration the disengaging time of the associated coupling. This position transmitter and possibly an additional position transmitter, controls simultaneously the drive or the coupling for the lifting of the supporting arms 21 and triggers the needle inserting motion of the carrier 9. The opening of the hose squeezing valves 15 is triggered by the weighing device as soon as the tare of the receptacles to be filled has been determined. The opposing drive motions of the supporting arms 21 and of the carrier 9 are also triggered by the weighing device which simultaneously blocks the hose squeezing valve 15. Beyond that, the weighing device also turns on again the wcrm conveyer drive, possibly by way of its controllable drive coupling. The drive cycle of the filling station is thereby independent of the filling time. In order to prevent the sliding of additional receptacles 1 over the conveyer belt 17 when the worm conveyers are moved away from each other, the conveyer belt 17 is either turned off or an additional blocking finger, which is not shown in detail, is slid into the conveying path of the receptacle 1.

Figure 3:
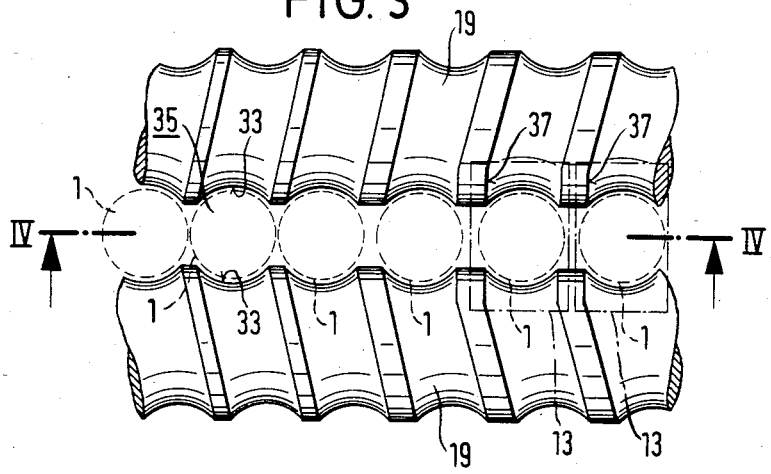
FIG. 3 shows a top view of worm conveyers of the filling station according to FIG. 1.
Figure 4:
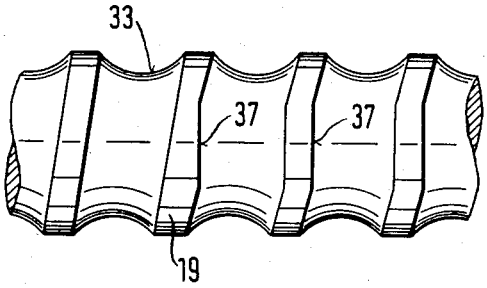
FIG. 4 shows a side elevation view of one of the worm conveyers of FIG. 3 along a line IV—IV.

FIGS. 3 and 4 show details of the worm conveyer 19. The worm conveyers have concave, preferably circularly bent, worm threads 33 with pushing surfaces which match the shape of the receptacle and are located opposite each other in the plane of the axes while cooperatively forming receptacle holding spaces 35. The rise or pitch of the worm conveyers 19 increases from the receptacle holding end, that follows the conveyer belt 17, to the zone of the weight sensor 13 and decreases again from this zone toward the receptacle discharge end on the conveyer belt 19. The receptacles 1 moved in contact with each other by the conveyer belt 17, are moved away from each other in the conveying direction by the worm conveyers so that they no longer have any contact with each other on the weight sensors 13.

FIG. 4 shows a lateral view of the worm conveyers 19 in the plane of the axes. In the zone of the weight sensors 13, the worm threads, normal to the worm axes, run over part of the circumference the worm, for instance, of 60°, and form rest threads 37 which, in spite of the rotation of the worm, do not convey the receptacles 1. The worm conveyers 19 can therefore be stopped in a relatively large angle of rotation without position errors of the receptacles 1 relative to the filling needles 5 or the weight sensors 13 having to be feared. Beyond that, the receptacles 1 are already braked in spite of still rotating worm conveyers so that the synchronization with the drive motion of the supporting arms 21 is not critical. This is advantageous especially if receptacles having different cross sectional dimensions are supposed to be conveyed by one and the same conveyer worm. However, the conveyer worms 19 can also be attached interchangeably on the supporting arms 21, for instance by means of quick couplings, so that they can be changed to accomodate different receptacles.

The weight sensors 13 of the weighing device must be attached so as to be kept as free from vibration as possible in order to avoid false dosing. As FIG. 2 shows, the weight sensors 13 are all on a frame 39 which is separate from the machine frame 25 and stands in a shaft 43 of the machine bed frame on supports 41 or on legs without contact with the machine 25. In this manner the vibrations of the frame are not transferred to the frame 39 and the weight sensors 13.

The filling station is suited especially for filling sterile liquids. Since no valves or dosing pumps endangered by abrasion dust are used, a high degree of purity can be observed. As far as sterilizing filters 45 in the flow path of the hose 7 which filter the liquid so that it is sterile, these sterilizing filters are inserted before the hose squeezing valves 15. In this manner, a dripping of the filling needles can be prevented because of the pumping effect of the hose on the inlet side of the filters that is brought about by elastic hose walls.

The filling station of FIGS. 1 and 2 shows additionally a clean air filter 47 which is optional. The clean air filter 47 is arranged on the side facing away from the operating side of the filling station, i.e. on the side of the receptacle 1 opposite the filling needle carrier 9, and produces an essentially horizontal, laminar, filtered clean air stream directed toward the operating side, which is not obstructed by the carrier 9 and the like and where, for instance, the hose squeezing valves 15 and the sterilizing filters 45 can be arranged. Based on the type of arrangement of the clean air blower 47, the number of particles in the zone of the filling station can be optimally reduced. The cross sectional surface of the clean air stream is here relatively small since the structural height is relatively low because no dosing pumps or the like are present.

Figure 5:
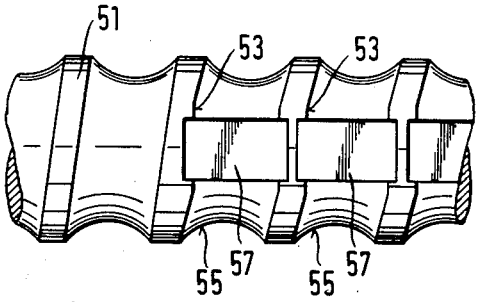
FIG. 5 shows a side elevation view of another embodiment of a worm conveyer.

FIG. 5 shows another embodiment of worm conveyers 51 as can be used in a filling station of FIGS. 1 and 2. The worm conveyer 51 differs from the worm conveyer 19 by the fact that in its rest threads 53, corresponding to the rest threads 37, has over the entire axial winding length of its worm threads flattenings or recesses 57 which reduce the radius of the worm conveyer 51. The recesses 57 enlarge the holding spaces for the receptacles in the zone of the weight sensors. In the worm threads 55, the receptacles are slid into the filling position. In the filling position in which the receptacles are not conveyed because of the rest threads 53, the recesses 57 prevent any contact of the worm conveyers 51 with the receptacle. Worm conveyers 51 according to FIG. 5 need not be radially moved during the weighing and filling phase. It is sufficient that during the weighing and filling operation, the rotary motion of the worms is stopped. With a filling time which is short in comparison to the succession time of the receptacles, a continuous operation with continuously rotating worm conveyers 51 is also possible.

FIG. 6 shows another form of a conveying device usable in the filling station of FIGS. 1 and 2. The conveying device moves the receptacles 61 linearly row through the filling station. It includes merely a worm conveyer 63 in whose worm thread the receptacles 61 engage. A guide rail 65, parallel to the axis of rotation of the conveyer worm 63, holds the receptacles 61 engaged with the worm thread of the worm conveyer 63. The worm conveyer 63 and the guide rail 65 are held on supporting arms 67 and the worm conveyer 63 is driven rotationally. The supporting arms 67 correspond to the supporting arms 21 of FIGS. 1 and 2 and permit the lifting of the conveyer worm 63 or of the guide rail 65 from the receptacles 61 during the weighing and filling phase. The conveyer worm 63 corresponds to the conveyer worm 19.

FIG. 7 shows another embodiment of a conveying device by means of which receptacles 71 are moved in a linear row through a filling station which doses depending on weight. The conveying movement of the receptacles 71 is brought about by a stationary worm conveyer 73. A guide rail arranged parallel to the axis of rotation of the conveyer worm 75 holds the receptacles 71 in engagement with the worm threads 77 of the worm conveyer 73 (FIG. 8) during the conveying movement. In the zone of the weight sensors of the weighing device, which are not shown in detail, ejectors 81 are movably arranged in circumferential grooves 79 of the conveyer worm 73 that extend normal to the worm axis by means of which the receptacles 71 can be pushed out of the worm threads 77 of the radially fixed conveyer worm 73. The guide rail 75 is also movable in the direction of the ejectors 81. Before the start of the weighing and filling operation, the ejectors 81 move the receptacles 71 out of bearing contact with the worm threads of the conveyer worm 73. Simultaneously the guide rail 75 is lifted. The ejectors 81 are withdrawn so that the receptacles 71 stand free on the weight sensors of the weighing device. After the filling of the receptacles the guide rail 75 slides the receptacles 71 again into the worm threads 77. The worm conveyer 73 can be designed similarly to the worm conveyer 19 of FIGS. 3 and 4. Where a worm conveyer similar to the worm conveyer 51 of FIG. 5 is used, the ejectors 81 can be omitted.

FIG. 9 shows a section of an endless conveyer chain by means of which receptacles 91 can be conveyed in a linear path through a filling station for bulk material, especially liquids, which doses by weight. The conveyer chain has chain links 95, 97 which are connected with each other in pairs by way of a joint 93 and themselves are flexibly connected with the pairs of chain links preceding or following in the longitudinal direction of the chain. The ends of the chain links 95,97 facing away from the common joint 93 carry arms 101,103 which protrude transverse to the longitudinal direction of the chain. In the zone of the weight sensors, which are not shown in detail, the guides 105 are designed in such a way that there can be a swinging movement of the chain links 95,97 around their connection joints 105,107 holding the adjacent intermediate links 99. In FIG. 9, on the side facing the receptacles 91, the guides 105 are provided with an interruption into which the common link 93 can swing. The swinging motion is carried out by a pushing element 109 driven synchronously with the operation of the filling station and opens the arms 101,103. The receptacle 91 thus stands free on the weight sensor of the weighing device during the weighing and filling operation.

FIG. 10 shows a conveying device for filling stations dosing by weight, especially for liquids, where two endless conveyer chains 111,113 are arranged in such a way that in the zone of their conveying path 115 they run parallel to each other. Both conveyer chains 111,113 support arms 117 and 119 which as spaced uniformly in the direction of conveyance a first distance substantially equal to the spacing of the weight sensors and protrude within the conveying path 115 each time toward the other conveyor chain. The arms 117 of the conveyer chain 111 extend between the arms 119 of the conveyer chain 113 and vice versa. The receptacles 121 to be conveyed are held between pushing surfaces on the arms 117 and 119 of the endless chains 111,113. For the weighing and filling phase the receptacles 121 are stopped without contact by arms 117 and 119 by the fact that the arms 119 of the endless chain 113, which move ahead in the conveying direction, are moved on in the conveying direction while the arms 117 following in the conveying direction are moved in the opposite direction over a specified length. For this purpose, the direction of rotation of the drive chain 111 is reversed for a short time.

FIG. 11 shows a conveying device for filling stations dosing by weight, especially for liquids, where the receptacles to be filled are arranged between two racks 131,133. The racks 131, 133 are provided with holders 135 or 137 spaced uniformly in the conveying direction, which follow each other in the conveying direction and enclose between themselves the receptacles to be filled. The racks 131,133 are moved through closed paths of motion running in opposite directions with the length of the stroke in the conveying direction and the length of the backstroke being equal to the spacing of the holders 135,137 in the conveying direction. The transverse stroke lengths are such that the racks 131,133 can be moved along the receptacles 139. The weighing and filling operation takes place during the backstroke when the racks 131,133 are not engaged with the receptacles 139. If required, the racks 131,133 can be stopped during the backstroke.

The conveying device of FIG. 12 includes a rack 141 with holds 143, which are uniformly spaced in the conveying direction, for reception of the receptacles 145 to be filled. On the side of the receptacle 145 facing away from the rack 141 there is arranged, in contrast to the conveying device of FIG. 11, a guide rail 147 which holds the receptacles 145 engaged with the holds 143. The rack 141 again is moved along a closed path of movement where the stroke in the conveying direction and the backstroke are equal to the spacing of the holds 143. The transverse stroke again is such that the receptacles 145 can leave the holds 143 during the backstroke. The guide rail 147 is movable transverse to the conveying direction and is lifted from the receptacles 145 during the weighing and filling phase. The weighing and filling phase is carried out during the backstroke of the rack 141.

Figure 13:
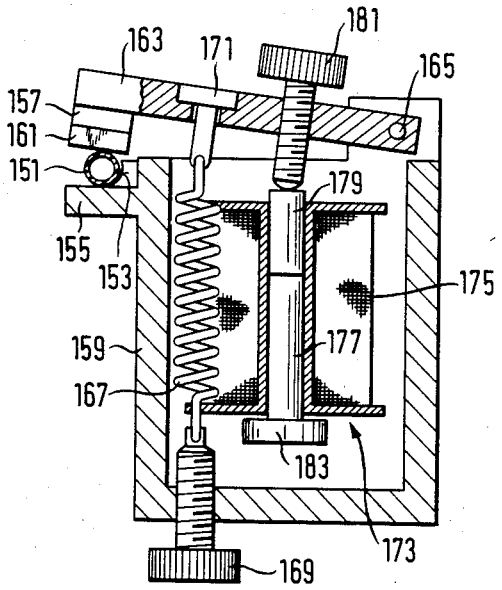
FIG. 13 shows a schematic, of a hose squeezing valve partially in cross section usable in the filling station for the control of the flow of liquids.

FIG. 13 shows a hose squeezing valve as it can be used in one of the aforementioned filling stations for the blocking of the hose leading to the filling needles. The hose identified by 151 is guided in a guide 153 between two pincer jaws 155,157 of squeezing pincers. The jaw 155 is firmly connected on a drive housing 159. The jaw 157 carries a blade 161 running transverse to the longitudinal extent of the hose and protrudes from a plate 163 which is placed on the drive housing 159 and swingable around an arbor 165 running approximately in the longitudinal direction of the hose. Between the plate 163 and the drive housing 150 there is clamped a tension spring 167 whose tensional force is so great that it can squeeze off the hose 151 tightly in any operating situation. The end of the tension spring 167 on the housing side attaches on a set screw 169 by means of which the length of the tension spring 167 can be varied in order to adjust the tensional force. The end of the tension spring on the plate side is placed in a rotary bearing 171 on the plate 163. The drive housing 159 contains several electromagnets 173 which are arranged next to each other in the direction of the arbor 165 and have exciter windings 175 independent of each other and ferromagnetic armature pieces 177 movable independent of each other and transverse to the plate 163. The armature pieces 177 are moved toward the plate 163 when the exciter windings 175 are excited and through spacers, which are also movable, push the plate 163 and thereby the jaw 157 away from the jaw 155 in the opposite direction. The spacers 179 hit on set screws 181 which are placed in the plate 163. On the side facing away from the set screws 181, the armatures 177 have heads 183 which limit the armature stroke to a specified value. By means of the set screws 181, the stroke of the pincers to be carried out in connection with the specified stroke of the armature can be adjusted separately for each electromagnet 173.

By means of the hose squeezing valve explained in the preceding, the flow through the hose 151 can be controlled in steps by exciting the individual electromagnets 173. At the start of the filling operation an electromagnet opening the hose 151 wide is excited. When the weight of the receptacle approches the desired value, this electromagnet is switched off and an electromagnet adjusted to a smaller stroke is excited.

FIG. 14 shows a block diagram of the weighing device of a single filling place of the filling station. A weight sensor 201 loadable with the weight of the receptacle is connected to a signal scanning and holding step 205 by way of a preferably active low-pass filter 203. The weight sensor 201 transmits a signal proportionate to the weight of the receptacle. The filter 203 filters out interferences based on vibrations or the like. The signal scanning and holding step is triggered by control contacts of the conveying device before the start of the following operation after the conveying organs, for instance, the worm conveyers, have been lifted away from the receptacle standing on the weight sensor 201. The signal scanning and holding device 205 thereby stores a signal corresponding to the empty weight or tare of the receptacle to be filled until it receives by way of its trigger input 207 the next scanning command for a following receptacle. An addition step 209 adds to the signal of the signal scanning and holding step 205 proportionate to the tare a signal of an adjustable signal transmitter 211 proportionate to the net weight of the quantity of bulk material to be filled. The output signal of the addition step 209 corresponds thereby to the desired gross weight of the filled receptacle. A comparator 213 compares the signals transmitted from the addition step 209 and, by way of the low-pass filter 203, from the weight sensor 201 transmits to its output 215 a blocking signal which terminates the charging of the receptacle with bulk material and closes the hose squeezing valve 15 in the case of the filling station of FIG. 1.

The throughput of bulk material or liquid is changeable in steps. The comparator 213 controls the smallest throughput step. In FIG. 14, there is merely provided another step for a higher throughput which is blocked by a comparator 217 by way of its output 219 when the actual weight of the receptacle exceeds a specified value. The comparator 217 compares the signal of the weight sensor 201 proportionate to the weight transmitted by way of the low-pass filter 203 with the output signal of a subtraction step 221 which subtracts a desired value signal of adjustable desired value means 223 from the gross weight signal of the addition step 209. The desired value means 223 specifies the weight difference which, after the turning off of the "rough" step, is still to be equalized by the "fine" step.

The weighing device of FIG. 14 includes merely two throughput steps. Further throughput steps can exist, with two additional components, corresponding to the elements 217 to 223, having to be provided additionally additionally. In place of the subtraction step 221 there can also be provided addition steps which are to be connected directly to the output of the signal scanning and holding step 205. The net weight to be filled in by the "rough" step is set on the desired value means.

To the output of the signal scanning and holding step 205 there is furthermore connected a monitoring circuit 225 which monitors the tare of the receptacle as to whether it is within specified weight limits. The filling operation is blocked if the tare is outside the specified weight limits. For instance, the tare can be low if the receptacle is partly broken. On the other hand, the receptacle can still be partly filled from preceding washing operations which is expressed in a tare that is too high.

A timing circuit 227, which is triggered when the "rough" filling operation is completed, is connected to the output of the comparator steps 217 controlling the "rough" throughput. The timing circuit 227 blocks first the comparator 213 of the "fine" filling step by way of a line 229 in order to assure that vibrations of the receptacle and of its content have died out before the "fine" filling operation is started. Furthermore, a monitoring circuit 231, which monitors the blocking signal of the comparator 213 when the specified time of the timing circuit 227 has expired, is connected to the timing circuit and the output of the comparator 213. If a blocking signal occurs after the end of the time constant, the monitoring circuit indicates that the receptacle was overfilled already during the preceding filling steps so that the desired value of the desired value means 223 must be changed.

FIG. 15 shows the circuit diagram of a compensation circuit by means of which the effects of undesirable oscillations or vibrations can be compensated in the output signal of the weight sensor. In FIG. 15, the measured weight sensor detecting the weight of the receptacle during the filling operation is signified by 241. 243 signifies a compensation weight sensor which is mechanically connected with the measured weight sensor 241 and thereby is exposed to the same vibrations. The weight-proportionate signal transmitted by the compensation weight sensor 243 is transmitted to a mean value memory 245 which stores a signal proportionate to the basic load of the compensation weight sensor 243. The signal stored in the mean value memory 245 is essentially free from signal changes caused by oscillations or vibrations. A difference step 247, for instance, a difference amplifier, subtracts the output signal of the compensation weight sensor 243 from the output signal of the mean value memory 245. The output signal of the difference step 247 thus represents in an inverted form an error signal which is proportionate to the weight error caused by vibrations or oscillations. An addition step 249 adds the inverted error signal of the difference step 247 to the output signal of the measured weight sensor 241 and compensates thereby the error caused by oscillations or vibrations.

We claim:

1. A device for the metered filling of bulk materials and particularly liquids in receptacles comprising:

first and second weight metering units each having:

(a) filling means for successively feeding the receptacles with bulk material; and (b) means for sensing the weight of the receptacles and for blocking the filling means when a predetermined combined weight of the receptacle and material in the receptacle has been exceeded; said means for sensing and blocking having:

(i) first and second electric weight sensors spaced from each other by a first distance and capable of generating a signal corresponding to the weight of a receptacle and its contents being weighed thereby;

(ii) a signal sample and hold circuit coupled to each weight sensor; and (iii) an adding circuit; and (c) flow control means to selectively allow flow of materials from the filling means and block flow of materials from the filling means;

a first frame;

means mounting the filling means to the first frame;

conveyor means for supplying the first and second receptacles groupwise to the weight metering units for simultaneous feeding with bulk material, said conveying means having:

(a) conveyor means on a first side of the weight sensors and extending in a direction of conveyance of the receptacles; and (b) means mounting the conveyor means to the first frame;

a second frame separate from and independent of the first frame and the filling means;

means for mounting the weight sensors to the second frame;

a plurality of pushing surfaces associated with the transport means for engaging the receptacles, said plurality of pushing surfaces spaced one from the other by the first distance;

means for operating the conveyor means intermittently to advance the pushing surfaces and thereby the receptacles in the conveying direction;

means for moving the pushing surfaces with the first and second receptacles situated over the first and second sensors away from the receptacles;

said signal sample and hold circuit triggerable by the conveyor means when the pushing surfaces are moved away from the receptacles to store a tare signal value corresponding to the empty weight of a receptacle associated therewith to be filled and after storage of the tare signal value releasing the filling means to fill the recepatcle;

a settable nominal value generator for storing a net weight signal value, said adding circuit adding the tare signal value and the net weight signal value; and a comparator circuit coupled to the weight sensor and the adding circuit and causing the flow control means to block flow of material from the filling means when a signal of the weight sensor represents a higher weight than the signal of the adding circuit.

2. The device according to claim 1 wherein the conveyor means on the first side of the weight sensors comprises a rotationally driven first worm conveyor whose worm thread defines the pushing surfaces to engage the receptacles, there being on a second side opposite the first side of the weight sensors a second rotationally driven worm conveyor having a worm thread pitched oppositely to the thread on the first worm conveyor, said worm threads on the first and second worm conveyors cooperatively forming holding spaces for the receptacles and means are provided for moving both conveyors worms in opposite directions away from the receptacles with the receptacles on the weight sensors and conveying by the conveying means interrupted and after the charging with bulk material to put the worm pushing surfaces back into conveying engagement with the receptacles.

3. The device according to claim 1 wherein the conveyor means on the first side of the weight sensors comprises a rotationally driven first worm conveyor whose worm thread defines the pushing pushing surfaces to engage the receptacles, an elongate guide rail is provided spaced from and parallel to the first worm conveyor, said guide rail keeping the receptacles engaged with the worm thread, and means are provided for moving the first conveyor worm and the guide rail in opposite directions away from the receptacles on the weight sensors with conveying interrupted and to put the worm surfaces and receptacles back into conveying engagement after the charging of the receptacles with bulk material.

4. The device according to claim 1 wherein the conveyor means on the first side of the weight sensors comprises a rotationally driven first worm conveyor whose worm thread defines the surfaces to engage the receptacles, an elongate guide rail is provided spaced from and parallel to the first worm conveyor, said guide rail keeping the receptacles engaged with the worm thread, movable ejectors are associated with the first worm conveyor, means are provided to move the ejectors radially with respect to the first conveyer worm and to deflect receptacles out of driving engagement with the first worm conveyor and to move back the ejectors with conveying interrupted after the charging of the receptacles with bulk material and means are provided to move the guide rail away from the receptacles with conveying interrupted and to move back the guide rail and thereby put the receptacles again in conveying engagement with the conveyer worm.

5. The device according to claim 1 wherein the conveyor means on the first side of the sensors comprises a rotationally driven worm conveyer whose worm thread defines the pushing surfaces to engage the receptacles and the relationship between the worm threads and receptacles is such that the receptacles are guided with play as they move in the conveying direction with rotation of the conveyer worm in a first direction and that during interruptions of the conveying the conveyer worm can be rotated back in a direction opposite to the first direction of worm rotation to back the pushing surfaces away from the receptacles.

6. The device according to claim 1 wherein the conveyor means on the first side of the sensors comprises a rotationally driven worm conveyer whose worm thread defines the pushing surfaces to engage the receptacles, said conveyor worm being provided with flats which reduce the radius of the worm thread over part of the circumference of the worm.

7. The device according to claim 1 wherein each metering device has at least one hose squeezing valve with hose squeezing pincers prestressed by a closing spring in a flow blocking direction which pincers can be opened against the force of the closing spring by means of a plurality of drives controllable by the weight sensing means, said drives acting cooperatively on the hose squeezing pincers and having independently adjustable drive strokes.

8. The device according to claim 1 wherein each metering device has at least one hose squeezing valve with hose squeezing pincers prestressed by a closing spring in a flow blocking direction which pincers can be opened against the force of the closing spring by means of a plurality of drives, each said drive comprising an electromagnet having a movable armature which causes opening of the hose squeezing pincers and wherein the movement of the armature is adjustable.

9. The device according to claim 1 wherein each metering unit has at least one hose squeezing valve with hose squeezing pincers prestressed by a closing spring in a flow blocking direction which pincers can be opened against the force of the closing spring by means of a drive controllable by the weighing device, and to facilitate filling with sterile liquids a filter is provided between a supply tank for the liquid on a connecting hose communicating liquid between the supply tank and a mouthpiece that delivers liquid to the receptacles, said hose squeezing valve squeezing the hose line at a point downstream of the sterilizing filter in the liquid conveying direction in the hose.

10. The device according to claim 1 wherein to an electrical weight sensor, which in the filling station can be loaded with the weight of the receptacle and transmits a signal corresponding to the weight, there is connected a signal scanning and holding step which is synchronized with the cycle of movement of the conveying means and before the release of the flow of bulk material stores a tare signal value corresponding to the weight of an empty receptacle to be filled, that an addition step adds the tare signal value and a net weight signal value of an adjustable desired value setter and that a comparator step connected to the weight sensor and to the addition step transmits a signal blocking the flow of bulk material of the dosing device when the signal of the weight sensor represents a weight higher than that of the signal of the addition step and the throughput of bulk material of the metering unit is changeable in steps, the comparator step connected to the addition step and to the weight sensor controls the smallest throughput step of the metering units, for each of the other throughput steps another adjustable desired value setter is provided and that a subtraction step subtracts the signal of another desired value setter from the signal of the addition step and that for the control of the other throughput steps of the metering units there is provided each time another comparator step connected to the weight sensor and to the subtraction step.

11. The device according to claim 1 wherein to an electrical weight sensor, which in the filling station can be loaded with the weight of the receptacle and transmits a signal corresponding to the weight, there is connected a signal scanning and holding step which is synchronized with the cycle of movement of the conveying means and before the release of the flow of bulk material stores a tare signal value corresponding to the weight of an empty receptacle to be filled, that an addition step adds the tare signal value and a net weight signal value of an adjustable desired value setter and that a comparator step connected to the weight sensor and to the addition step transmits a signal blocking the flow of bulk material of the dosing device when the signal of the weight sensor represents a weight higher than that of the signal of the addition step and the throughput of bulk material of the metering unit is changeable in steps, the comparator step connected to addition step and to the weight sensor controls the smallest throughput step of the metering units, for each of the other throughput steps another adjustable desired value setter is provided and that another addition step adds the signal of another desired value setter to the signal of the signal scanning and holding step, and that for the control of the other throughput steps of the metering units there is provided each time another comparator step connected to the weight sensor and to the other addition step.

12. The device according to claim 10 or 11 wherein a timing circuit, which is triggered when a throughput step of the metering units is blocked, is connected to the other comparator step and that to the comparator step assigned to the timing circuit and to the smallest throughput step there is connected a monitoring circuit which after the expiration of a period specified by the timing circuit generates a signal corresponding to the state of the comparator signal.

13. Device as defined in claim 12, characterized by the fact that, for the duration of its specified period, the timing circuit blocks the smallest throughput step of the metering unit.

14. The device according to claim 1 wherein to an electrical weight sensor, which in the filling station can be loaded with the weight of the receptacle and transmits a signal corresponding to the weight, there is connected a signal scanning and holding step which is synchronized with the cycle of movement of the conveying device and before the release of the flow of bulk material stores a tare signal value corresponding to the weight of the empty receptacle to be filled, that an addition step adds the tare signal value and a net weight signal value of an adjustable desired value setter and that a comparator step connected to the weight sensor and to the addition step transmits a signal blocking the flow of bulk material of the dosing device when the signal of the weight sensor represents a weight higher than that of the signal of the addition step, there being a low-pass filter between the weight sensor and the smallest scanning and holding step.

15. The device according to claim 1 wherein to an electrical weight sensor, which in the filling station can be loaded with the weight of the receptacle and transmits a signal corresponding to the weight, there is connected a signal scanning and holding step which is synchronized with the cycle of movement of the conveying device and before the release of the flow of bulk material stores a tare signal value corresponding to the weight of the empty receptacle to be filled, that an addition step adds the tare signal value and a net weight signal value of an adjustable desired value setter and that a comparator step connected to the weight sensor and to the addition step transmits a signal blocking the flow of bulk material of the dosing device when the signal of the weight sensor represents a weight higher than that of the signal of the addition step, there being a low-pass filter between the weight sensor and the smallest scanning and comparator step.

16. Device as defined in claim 1 characterized by the fact that in the zone where the receptacles are filled there is arranged a compensation weight sensor which is loadable with a constant weight and to which a mean value memory forming the mean time value of the signals of the compensation weight sensor is connected and that a subtraction step takes the difference of the signals of the compensation weight sensor and of the mean value memory and subtracts it from the signal of the measured weight sensor loaded with the receptacle.

17. The device according to claim 1 wherein an electrical weight sensor, which in the filling station can be loaded with the weight of the receptacle and transmits a signal corresponding to the weight, there is connected a signal scanning and holding step which is synchronized with the cycle of movement of the conveying device and before the release of the flow of bulk material stores a tare signal value corresponding to the weight of the empty receptacle to be filled, that an addition step adds the tare signal value and a net weight signal value of an adjustable desired value setter, that a comparator step connected to the weight sensor and to the addition step transmits a signal blocking the flow of bulk material of the metering units when the signal of the weight sensor represents a weight higher than that of the signal of the addition step, and in the zone where the receptacles are filled there is arranged a compensation weight sensor which is loadable with a constant weight and to which a mean value memory forming the mean time value of the signals of the compensation weight sensor is connected and that a subtraction takes forms the difference of the signals of the compensation weight sensor and of the mean value memory and subtracts it from the signal of the measured weight sensor loaded with the receptacle.

18. The device according to claim 1 wherein an electrical weight sensor, which in the filling station can be loaded with the weight of the receptacle and transmits a signal corresponding to the weight, there is connected a signal scanning and holding step which is synchronized with the cycle of movement of the conveying device and before the release of the flow of bulk material stores a tare signal value corresponding to the weight of the empty receptacle to be filled, that an addition step adds the tare signal value and a net weight signal value of an adjustable desired value setter and that a comprator step connected to the weight sensor and to the addition step transmits a signal blocking the flow of bulk material of the dosing device when the signal of the weight sensor represents a weight higher than that of the signal of the addition step and to the signal scanning and holding step there is connected a monitoring circuit which generates a signal that blocks the metering unit when the tare signal value is outside a specified range.

* * * * *